US006568324B1

(12) United States Patent
Franklin et al.

(10) Patent No.: US 6,568,324 B1
(45) Date of Patent: May 27, 2003

(54) INKING UNIT OF A PRINTING MACHINE, AND ASSOCIATED METHOD

(75) Inventors: Stephen Franklin, Durham, NH (US); Wolfgang Schönberger, Schriesheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 28 days.

(21) Appl. No.: 09/624,447

(22) Filed: Jul. 24, 2000

(30) Foreign Application Priority Data

Jul. 23, 1999 (DE) ..... 199 34 702

(51) Int. Cl.[7] ..... B41F 31/02
(52) U.S. Cl. ..... 101/364; 101/425; 101/367
(58) Field of Search ..... 101/364, 148, 101/425, 367, 132.5, 147, 204, 205, 206, 207, 208; 134/111

(56) References Cited

U.S. PATENT DOCUMENTS

| | | | | |
|---|---|---|---|---|
| 4,753,165 A | | 6/1988 | Grosshauser | |
| 5,103,730 A | * | 4/1992 | Sarda | 101/425 |
| 5,121,689 A | | 6/1992 | Fadner | |
| 5,226,364 A | | 7/1993 | Fadner | |
| 5,619,920 A | * | 4/1997 | MacPhee | 101/148 |
| 5,713,282 A | * | 2/1998 | MacPhee | 101/148 |
| 6,318,387 B1 | * | 11/2001 | McClure | 134/111 |

FOREIGN PATENT DOCUMENTS

| | | | |
|---|---|---|---|
| DE | 226 839 A1 | | 9/1985 |
| DE | 35 41 458 A1 | | 5/1987 |
| DE | 37 25 971 A1 | | 2/1989 |
| DE | 42 13 636 A1 | | 10/1992 |
| JP | 40-3090359 A | * | 4/1991 |

* cited by examiner

*Primary Examiner*—Eugene H. Eickholt
(74) *Attorney, Agent, or Firm*—Laurence A. Greenberg; Werner H. Stemer; Ralph E. Locher

(57) ABSTRACT

An inking unit in a printing machine, having an ink reservoir, a dampening-solution reservoir, and conveying paths for conveying ink and dampening solution from the ink reservoir and the dampening-solution reservoir, respectively, to a web to be printed, and for conveying ink, that has emulsified with the dampening solution and that has not been picked up by the web, back to the ink reservoir, includes an ultrasonic transmitter installed so as excite an exposed dampening solution-carrying surface section of the inking unit.

7 Claims, 3 Drawing Sheets

INKING UNIT OF A PRINTING MACHINE, AND ASSOCIATED METHOD

BACKGROUND OF THE INVENTION

FIELD OF THE INVENTION

The invention relates to an inking unit of a printing machine, in particular an offset printing machine, having an ink reservoir, a dampening-solution reservoir, a system for conveying ink and dampening solution from the ink reservoir and dampening-solution reservoir, respectively, to a web to be printed, and for conveying ink that has emulsified with the dampening solution and has not been picked up by the web back to the ink reservoir, and having an ultrasonic transmitter. A printing machine having such an inking unit is disclosed by U.S. Pat. No. 5,121,689. In this application, the ultrasonic transmitter serves to excite an ink knife of a chambered doctor blade into ultrasonic oscillations and, in this way, to apply a thin film of ink with a thickness modulated by the ultrasound to a metering roller rotating in front of an opening of the chambered doctor blade.

Another example of a metering roller with an associated ultrasonic transmitter is disclosed in the published German Patent Document DE 42 13 636 A1. Provided on this roller are two devices for applying two different printing inks to different areas of the metering roller. These areas are spaced apart in the axial direction of the metering roller, and the ultrasonic transmitter focuses an ultrasonic beam onto a boundary area running annularly around the metering roller, in order to prevent penetration of inks from the two differently inked areas into this boundary area, and therefore to prevent mixing of the inks.

An important problem in the development and operation of printing machines, in particular for offset printing, is the correct metering of the dampening solution. Conventional printing machines use so-called inking units and dampening units to supply a printing plate mounted on a plate cylinder with ink and dampening solution. In the process, during a printing operation, unused dampening solution can get into the conveying path for ink belonging to the inking unit, and can dilute the printing-ink emulsion. Particularly in the case of short-form inking units, the dampening solution cannot emerge from the emulsion to a sufficient extent because of the low number of splitting points between rollers and the small roller surface. Particularly in the case of printing with lightweight printing forms having a low ink uptake, but with a correspondingly high amount of dampening solution on the printing plate, the proportion of dampening solution in the ink emulsion can in this way increase over the course of the operation, which leads to printing problems and, under certain circumstances, to breakdown of the offset process. In order to counter this problem, the published German Patent Document DE 35 41 458 A1 proposes the use of a blower, which directs an air flow onto a roller in the inking unit, in order to effect evaporation thereat of excess dampening solution.

This leads to considerable air movements within the inking unit and, respectively, the printing machine, which can have effects upon the amount of dampening solution on other surfaces than that of the roller to which the flow is directed. These effects may be both additional evaporation at these other surfaces and condensation at a different point of dampening solution evaporated from the roller at which the flow is directed. The number and extent of these effects may depend upon the changing climatic conditions in a room wherein the printing machine is set up. It is therefore difficult for an operator to control the output from the blower in a specific manner and without previous testing in such a way that a desired degree of dryness of the emulsion for optimum printing results is achieved.

Another approach to solving the foregoing problem is the use of additional rider rollers or a second applicator roller train, by which the number of splitting points and the surface available to evaporate the dampening solution are increased. However, specific control of the evaporation is thereby not possible. A further disadvantage of this approach is that the use of small rollers with a lower peripheral length than that of the printing plate can destroy the subject formed in the course of the printing operation on the ink applicator roller, which is adjusted to the size of the plate cylinder, and can therefore lead to undesired ghosting.

SUMMARY OF THE INVENTION

It is accordingly an object of the invention to provide an inking unit of a printing machine with a device which affords a specific and rapid control of the dampening solution component of an ink emulsion in a relatively simple manner, and a method of operating that device.

With the foregoing and other objects in view, there is provided, in accordance with one aspect of the invention, an inking unit in a printing machine, having an ink reservoir, a dampening-solution reservoir, and conveying paths for conveying ink and dampening solution from the ink reservoir and the dampening-solution reservoir, respectively, to a web to be printed, and for conveying ink, that has emulsified with the dampening solution and that has not been picked up by the web, back to the ink reservoir, comprising an ultrasonic transmitter installed so as excite an exposed dampening solution-carrying surface section of the inking unit.

In accordance with another feature of the invention, the surface section is part of a conveying path for the ink.

In accordance with a further feature of the invention, the excited surface section extends over the entire printing width of the printing machine.

In accordance with an added feature of the invention, the excited surface section is strip-shaped and defines with the ultrasonic transmitter an air gap therebetween, across which ultrasound is focussed by the ultrasonic transmitter onto the surface section.

In accordance with an additional feature of the invention, the surface section forms part of an inking-unit roller, and the ultrasonic transmitter is disposed in the interior of the inking-unit roller.

In accordance with yet another feature of the invention, the surface section includes the entire peripheral surface of the inking-unit roller, the ultrasonic transmitter being disposed so as to rotate jointly with the roller.

In accordance with yet a further feature of the invention, the roller is formed with a jacket, and the ultrasonic transmitter is disposed so as to be in physical contact with the jacket of the roller.

In accordance with yet an added feature of the invention, the inking unit has a plate over which the ink flows freely during operation of the machine, the excited surface section including at least part of the plate.

In accordance with yet an additional feature of the invention, the plate forms part of the ink-conveying path.

In accordance with still another feature of the invention, the ink reservoir includes an ink fountain and a chambered doctor blade, from which the ink is metered onto the conveying path, as well as a pump for conveying the ink from the ink fountain into the chambered doctor blade, the plate being disposed in a manner that excessive conveyed ink can flow back from the chambered doctor blade over the plate into the ink fountain.

In accordance with still a further feature of the invention, the plate is connected to the ink reservoir via a feed line and a discharge line, and the pump serves for exchanging ink between the plate and the ink reservoir.

In accordance with still an added feature of the invention, the plate, the pump and the ultrasonic transmitter are constructed as a retrofittable unit.

In accordance with still an additional feature of the invention, the excitable surface section is the surface of ink in an ink fountain, the ultrasonic transmitter being disposed on the housing of the ink fountain.

In accordance with another feature of the invention, the inking unit includes an extraction or suction device for extracting air from the vicinity of the excited surface section.

In accordance with a concomitant aspect of the invention, there is provided a method for metering the dampening-solution component of a printing-ink emulsion in a printing machine, which comprises subjecting a surface of the emulsion to ultrasonic oscillation in order to atomize at least part of the dampening-solution component.

Thus, the object of the invention is achieved initially by an inking unit of the type mentioned at the introduction hereto wherein the ultrasonic transmitter is installed so as to excite ultrasonic oscillations in a dampening solution-carrying section of the inking unit. This section must be exposed, so that dampening solution atomized by the ultrasonic oscillations can be carried away.

According to a first preferred embodiment, the surface section forms part of the conveying path for ink, and carries the dampening solution in the form of an emulsion of dampening solution and ink. In this regard, the viscosity of ink, which is higher compared to that of the dampening solution, has the effect that the dampening solution is preferably atomized and, in this way, effective drying of the emulsion is achieved.

The excited surface section preferably extends over the entire printing width of the printing machine, in order to achieve uniform drying over the entire printing width. For this purpose, the ultrasonic power is expediently also distributed homogeneously over the width of the section.

In accordance with a first alternative construction, provision is made for the surface section to be strip-shaped, and for the ultrasonic transmitter to focus ultrasound onto the surface section across an air gap.

According to a second alternative construction, provision is made for the surface section to be part of an inking-unit roller, and for the ultrasonic transmitter to be arranged in the interior of the inking-unit roller. This alternative offers the advantage that the ultrasound can be transferred to the surface section by structure-borne sound in a solid body, so that a lower transmitted power than in the case of ultrasonic excitation across the air gap is sufficient.

In this regard, the surface section preferably comprises the entire peripheral surface of the inking-unit roller, and the ultrasonic transmitter is arranged to rotate jointly with the roller.

According to a second preferred embodiment, the printing machine has a plate over which the ink flows freely during the operation of the machine, and the excited surface section comprises at least part of this plate. Because such a plate only has to bear a minimum mechanical loading, it can be formed very thin and lightweight, and can consequently be excited into high ultrasonic oscillations with a low transmitted power.

In a further development of this embodiment, provision is made for the reservoir to comprise an ink fountain and a chambered doctor blade, from which the ink is metered onto the conveying path for ink, as well as a pump for conveying the ink from the ink fountain into the chambered doctor blade, the plate being arranged in such a way that ink conveyed in excess can flow back from the chambered doctor blade into the ink fountain.

According to a third embodiment, provision is made for the plate to be connected to the ink reservoir via a feed line and a discharge line, and for a pump to be provided to exchange ink between the plate and the ink reservoir. In this configuration, the plate and the atomization which takes place thereon are independent of the conveying path, so that this embodiment is particularly well suited to the retrofitting of existing printing machines. To this end, it is sufficient to construct the plate, the pump and the ultrasonic transmitter as a unit which can be retrofitted and which, for example, merely has to be connected to the ink fountain of a conventional printing machine.

A further embodiment provides for the exposed surface section to be the ink surface in the ink fountain, and for the ultrasonic transmitter to be arranged on the housing of the ink fountain. In this case, in order to introduce the invention into a conventional printing machine, it is sufficient only to retrofit the ultrasonic transmitter to the ink fountain.

In order reliably to prevent the atomized dampening solution from being deposited again at other points in the printing machine, provision is preferably made for an extraction or suction device for extracting air and dampening solution contained therein from the vicinity of the excited surface section.

The object of the invention is further achieved by a method for metering the dampening-solution component of a printing-ink emulsion in a printing machine wherein a surface of the emulsion is subjected to ultrasonic oscillation in order to atomize at least partially the dampening-solution component contained therein.

Other features which are considered as characteristic for the invention are set forth in the appended claims.

Although the invention is illustrated and described herein as embodied in an inking unit for a printing machine and a method associated therewith, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
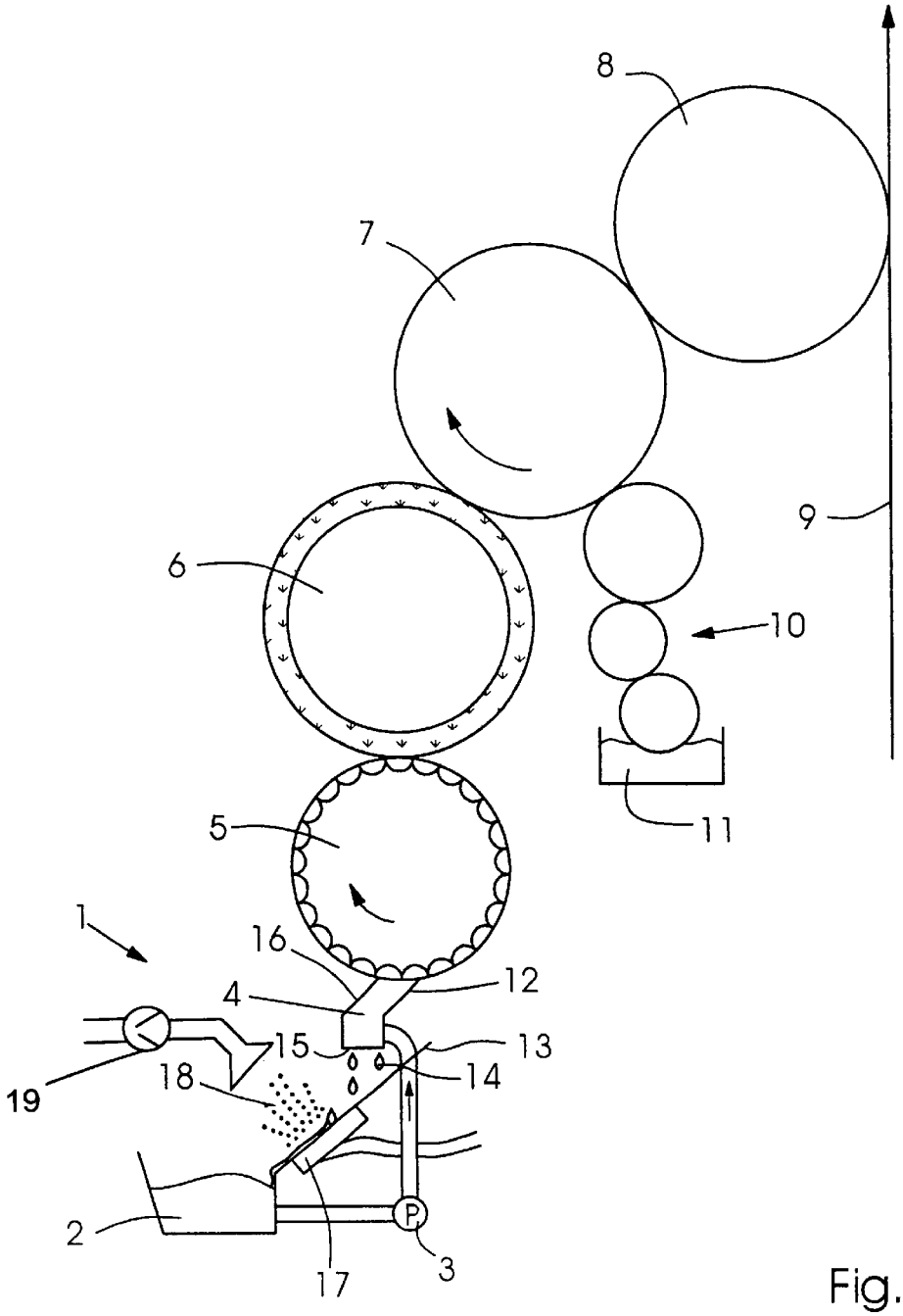
FIG. 1 is a diagrammatic side elevational view of an inking unit according to the invention in a printing machine.

Referring now to the drawings and, first, particularly to FIG. 1 thereof, there is shown therein, in a diagrammatic Cross-sectional view, a printing unit of a printing machine having an inking unit according to the invention. An ink reservoir 1 includes an ink fountain 2 and a chambered doctor blade 4, which is supplied with ink from the ink fountain by a pump 3. From the chambered doctor blade 4, the ink is metered in a conventional manner onto an anilox or screen roller 5 and transferred therefrom, via an ink applicator roller 6, a plate cylinder 7 and a blanket cylinder 8, onto a web 9 of a material to be printed, for example, paper. In this way, the rollers 5 to 8 form a first part of an ink conveying path, whereon ink is conveyed from the ink reservoir 1 to the web 9. Ink that is not picked up by the web 9 is conveyed back by the rollers in the opposite direction. On this return path, the ink is emulsified with dampening solution, which is applied to the plate cylinder 7 from a fountain 11 by a dampening unit 10, in order to wet, on the plate cylinder, surface areas which are not supposed to pick up ink. The rollers of the dampening unit 10, together with the plate cylinder 7 and the blanket cylinder 8, form a conveying path for the dampening solution.

A lock-up doctor blade 12 belonging to the chambered doctor blade 4 and, for example, scrapingly disposed, strips the conveyed-back emulsion from the projections on the screen roller 5, so that it flows down on an outer wall of the chambered doctor blade 4 and drips onto an oblique plate 13, as indicated by a drop 14.

The chambered doctor blade 4 is formed, on the underside thereof, with a row of openings 15, through which ink pumped into the chambered doctor blade 4 by the pump 3 and not picked up by the screen roller 5 likewise drips onto the plate 13. Further ink flows off a working doctor blade 16, over an outer wall of the chamber doctor blade 4, and likewise drips onto the plate 13. This ink is also, to a certain extent, emulsified with dampening solution.

Mounted on the underside of the plate 13 is an ultrasonic transmitter 17, which preferably extends over the entire width of the rollers 5 to 8 and, respectively, the plate 13. The ultrasonic transmitter 17 excites the plate 13 into oscillations with a high amplitude, by which the dampening-solution component of the ink emulsion flowing thereon is "shaken off" to a certain extent and is lifted off the plate 13 in the form of fine droplets 18. The droplets 18 are extracted by an extraction or suction device 19, which can be removed from the printing machine. A dried flow of ink flows from the plate 13 back into the ink fountain 2. The plate 13, together with the rollers 5 to 8, therefore forms the second part of an ink conveying path, for transporting ink back from the web 9 to the reservoir 1, where it is pumped out again into the chambered doctor blade 4 by the pump 3 and can again pass through the ink conveying path over the rollers 5 to 8 and the plate 13.

Figure 2:
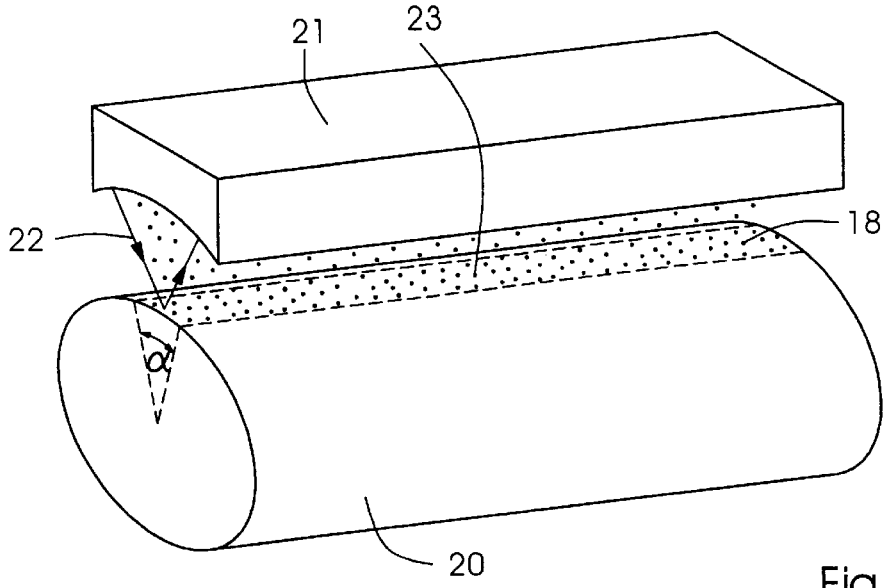
FIG. 2 is a diagrammatic side, front and top perspective view of an inking-unit roller with an associated ultrasonic transmitter in accordance with a different configuration than that of FIG. 1.

FIG. 2 shows a roller of a printing machine according to a second embodiment of the invention. The roller 20 can be any desired one of the aforementioned rollers 5 to 8 or a rider roller disposed in contact therewith. For the invention, it is essential only that the roller carry an emulsion of ink and dampening solution on the surface thereof. An ultrasonic transmitter 21 extends over the entire axial length of the roller 20 and is separated from the latter by an air gap 22. Due to the concave shape of the ultrasonic transmitter 21 facing the roller 20, the ultrasonic wave emitted by the transmitter 21 is focussed onto a strip-like surface section 23 of the roller 20, the extent of the section in the peripheral direction of the roller 20 being illustrated in the figure by the angle $\alpha$ on the end face of the roller 20. A mist of dampening-solution droplets 18 is thrown off the surface section 23 under the influence of the ultrasonic wave and is eliminated by a non-illustrated extraction or suction device.

Figure 3:
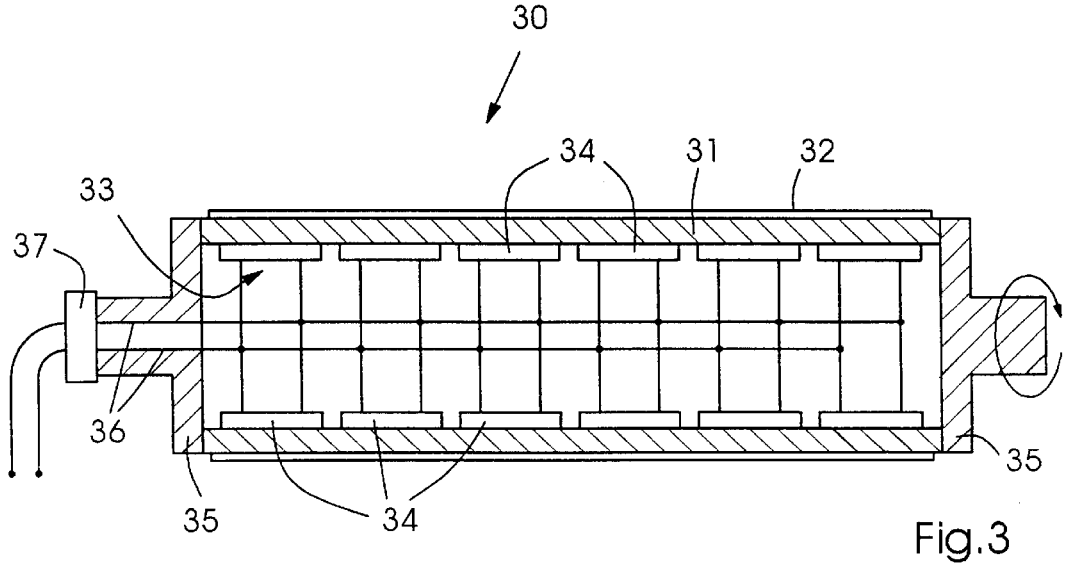
FIG. 3 is a longitudinal sectional view of an inking-unit roller with an installed ultrasonic transmitter in accordance with the invention.

FIG. 3 is an axial sectional view of a roller 30 for a printing machine in accordance with a third embodiment of the invention. The roller 30 includes a hollow cylindrical casing or jacket 31, for example formed of metal, which constitutes part of the ink conveying path of the machine and carries a layer 32 of ink/dampening-solution emulsion on the surface thereof.

Accommodated in the interior of the jacket 31 is an ultrasonic transmitter 33, which is made up of a multiplicity of individual transducer elements 34, which are distributed over the entire length of the ink layer 32, for the purpose of exciting the latter with ultrasonic oscillations with a power distributed homogeneously in the axial direction and in the peripheral direction. The individual transducer elements 34 are connected in parallel, and the electrical supply lines 36 thereof extend through one of two flanges 35 that close the open ends of the jacket 31 and are rotatably suspended in the frame of the printing machine. A rotary leadthrough 7, for example having two concentric slip rings, serves for connecting the supply line 36 to a stationary external high-frequency source.

As in the case of the aforedescribed exemplary embodiments, by excitation of the surface wetted with the ink emulsion, dampening solution is atomized thereat and can be extracted by suction. The quantity of dampening solution that is atomized is controllable, virtually without any delay, by the in-fed ultrasonic power.

Through the use of a non-illustrated embodiment, the transducer elements could also be accommodated in a stationary position in the interior of the roller, in particular in contact with the jacket that is rotatable over the surfaces thereof. Such a device could, respectively, irradiate only one sector of the cover instead of the entire periphery thereof with ultrasound, and thus exclude unexposed sections of the roller, for example sections which are in contact with other rollers, from the irradiation. Homogeneous distribution of the emitted ultrasonic power in the peripheral direction is not necessary here, since the relative movements of cover and ultrasonic transmitters ensure that each peripheral area of the cover is subjected to the same power.

Figure 4:
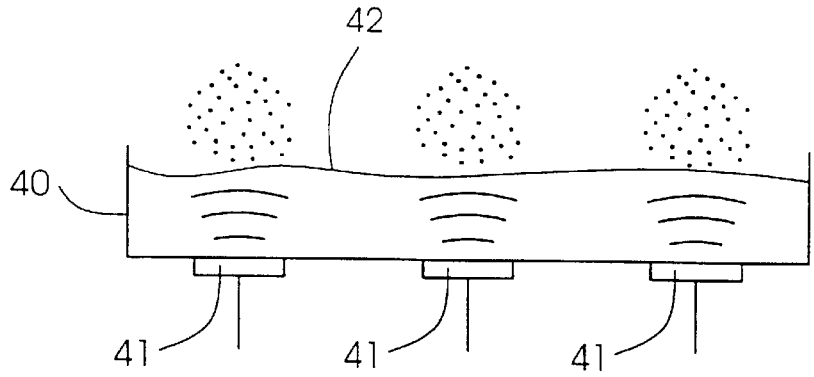
FIG. 4 is a diagrammatic side elevational view of an ink fountain equipped with ultrasonic transmitters in accordance with the invention.

FIG. 4 shows an ink fountain in an inking unit of a printing machine according to a fourth exemplary embodiment of the invention. Ink emulsion scraped off an engraved roller is lead back into the ink fountain 40 in a conventional manner which, accordingly, is therefore not illustrated in the figure. For this reason, following a relatively long period of operation, the ink fountain 40 likewise does not contain pure ink but an emulsion of ink and dampening solution. Disposed at the bottom of the ink fountain 40 are one or more transducer elements 41 of an ultrasonic transducer, which emit an ultrasonic oscillation upwardly through the ink stored in the fountain 40 and thus excite oscillations in the surface 42 of the ink. In this embodiment of the invention, it does not matter that the ultrasonic power be distributed homogeneously over the entire width of the ink fountain, because any possible inhomogeneities in the dampening-solution content of the ink in the ink fountain 40 are balanced out or equalized when the ink is pumped into the chambered doctor blade and, via the conveying path which follows the latter, is conveyed towards the web to be printed.

Figure 5:
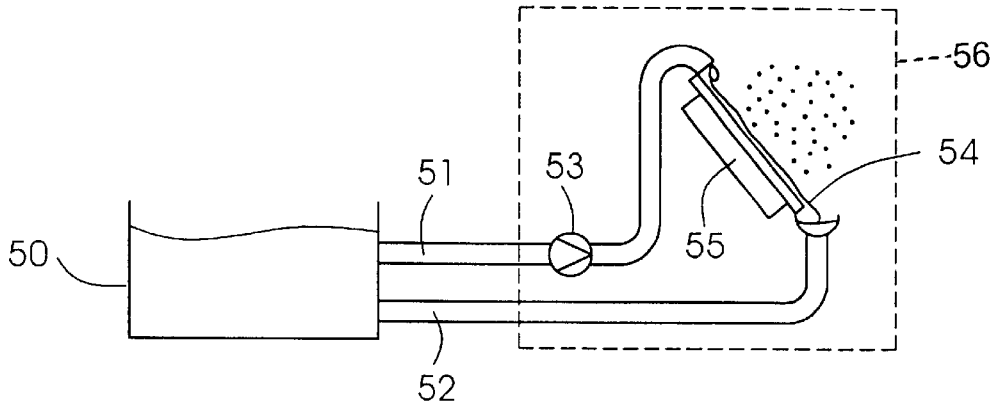
FIG. 5 is a diagrammatic side elevational view of a plate excitable into ultrasonic oscillations, the plate being provided in a subassembly which can be retrofitted.

FIG. 5 shows a fifth exemplary embodiment, wherein two lines 51 and 52 are connected to an ink fountain 50 and, with the aid of a pump 53, withdraw ink and permit it to flow over an inclined plate 54. Disposed on the rear of the plate 54, as in the embodiment of FIG. 1, is an ultrasonic transmitter 55, which atomizes dampening solution from the emulsion flowing over the plate 54. After the emulsion has crossed the plate 54, it is guided back to the ink fountain 50 via the line 52. As indicated by the box 56 shown in broken lines, this fifth embodiment is suitable for subsequent addition to an existing printing machine which for this purpose has to be retrofitted only with connections for the lines 51 and 52 to the ink fountain 50 thereof.

We claim:

1. In a printing machine, having an ink reservoir, a dampening-solution reservoir, and conveying paths for conveying ink and dampening solution from the ink reservoir and the dampening-solution reservoir, respectively, to printing material to be printed, and for conveying ink, that has emulsified with the dampening solution and that has not been picked up by the printing material, back to the ink reservoir, an inking unit comprising:

an ultrasonic transmitter installed so as excite an exposed dampening solution-carrying surface section of the inking unit; and a plate forming part of the ink conveying path, the ink flowing freely over said plate during operation of the printing machine, said surface section including at least part of said plate, the ink reservoir including an ink fountain and a chambered doctor blade for metering the ink onto the conveying path, the ink reservoir including a pump conveying the ink from the ink fountain into the chambered doctor blade, said plate being disposed in a manner that excessive conveyed ink can flow back from the chambered doctor blade over said plate into the ink fountain.

2. The inking unit according to claim 1, wherein said surface section is part of a conveying path for the ink.

3. The inking unit according to claim 1, wherein said excited surface section extends over the entire printing width of the printing machine.

4. The inking unit according to claim 1, including an extraction or suction device for extracting air from the vicinity of the excited surface section.

5. In a printing machine, having an ink reservoir, a dampening-solution reservoir, and conveying paths for conveying ink and dampening solution from the ink reservoir and the dampening-solution reservoir, respectively, to printing material to be printed, and for conveying the ink, that has emulsified with the dampening solution and that has not been picked up by the printing material, back to the ink reservoir, an inking unit comprising:

an ultrasonic transmitter installed so as excite an exposed dampening solution-carrying surface section of the inking unit; and a device selected from the group consisting of an extraction device and a suction device for extracting air from a vicinity of said surface section.

6. The inking unit according to claim 5, having a plate over which the ink flows freely during operation of the machine, said excited surface section including at least part of the plate.

7. The inking unit according to claim 6, wherein said plate forms part of the ink conveying path.

* * * * *